US005413315A

United States Patent [19]

Venas et al.

[11] Patent Number: 5,413,315

[45] Date of Patent: May 9, 1995

[54] INJECTION EQUIPMENT

[75] Inventors: Karl Venas, Saupstad; Terje Pedersen, Furnes, both of Norway

[73] Assignee: Norsk Hydro a.s., Oslo, Norway

[21] Appl. No.: 227,332

[22] Filed: Apr. 14, 1994

[30] Foreign Application Priority Data

Apr. 14, 1993 [NO] Norway ..... 931360

[51] Int. Cl.[6] ..... C21C 7/04

[52] U.S. Cl. ..... 266/222; 266/216; 266/235

[58] Field of Search ..... 266/216, 217, 221, 222, 266/235

[56] References Cited

U.S. PATENT DOCUMENTS

| | | | |
|---|---|---|---|
| 2,488,447 | 11/1949 | Tangen et al. | 266/235 |
| 2,890,039 | 6/1959 | Schmidt | 266/216 |
| 4,047,938 | 9/1977 | Szekely | 75/78 |
| 4,772,319 | 9/1988 | Otsuka et al. | 75/68 R |
| 4,804,168 | 2/1989 | Otsuka et al. | 266/235 |
| 4,832,740 | 5/1989 | Meier | 75/68 R |
| 4,908,060 | 3/1990 | Duenkelmann | 75/61 |

FOREIGN PATENT DOCUMENTS

| | | | |
|---|---|---|---|
| 0065854 | 12/1982 | European Pat. Off. . | |
| 0395138 | 10/1990 | European Pat. Off. . | |
| 155447 | 12/1986 | Norway . | |
| 1422055 | 1/1976 | United Kingdom . | |
| 0341851 | 7/1972 | U.S.S.R. | 266/235 |

*Primary Examiner*—Scott Kastler

*Attorney, Agent, or Firm*—Wenderoth, Lind & Ponack

[57] ABSTRACT

Injection equipment for the supply of gas and/or particulate material in the form of powder, granules, chips or similar shapes to a liquid, for example a metal melt, includes a rotation body which is designed to be lowered down into the liquid and which is mounted on and driven via a shaft of a drive unit. The material and/or gas is supplied to the liquid through the rotation body via a coaxial bore in a shaft thereof. The rotation body has a cone-like or funnel-like design and is generally completely open at the bottom.

13 Claims, 2 Drawing Sheets

INJECTION EQUIPMENT

BACKGROUND OF THE INVENTION

The present invention relates to injection apparatus or equipment for the supply of material such as gaseous and/or particulate material in the form of powder, granules, chips or similar shapes to a liquid, for example metal melt. The apparatus includes a rotation body which is designed to be lowered down into the liquid and which is mounted on and driven by a shaft of a drive unit.

Previous equipment and methods are known for processing and adding particulate material to a liquid as stated above. Thus, Norwegian Patent No. 155,447 discloses a rotor for processing and adding material to a liquid, whereby the rotor comprises a rotationally symmetrical hollow body and whereby the material is added to the liquid via a bore in the rotor shaft and onwards out through a hole in the side of the hollow body together with the liquid which, on account of centripetal force, is sucked in through an opening in the base and circulated through the body. Even if this rotor in itself causes the material to be well mixed in the melt, over time the material will build up inside the rotor, especially where large particles are involved, and eventually block it completely.

Furthermore, EP-A-0065854 describes a procedure for removing alkaline and earth-alkaline metals from aluminum melts whereby aluminum fluoride is introduced in powder form into an eddy produced in the melt. Processing takes place in a cylindrical container with the ability to hold 3–5 tonnes of aluminum melt. This known method requires substantial agitation of the melt to obtain the desired effect. However, such powerful agitation is not desirable as it causes air to be pumped into the melt. Furthermore, the quantity of aluminum fluoride which is required to process each tonne of melt is relatively high. Other generally known methods (for example as disclosed in Norwegian patent application No. 881,370) involve adding powder to a melt by means of a carrier gas through one or more lances. The disadvantages of using lances are that the consumption of gas is high and the efficiency is low. Even if the efficiency can be increased somewhat by also using an agitation device, the consumption of gas is equally high and the particles continue to be insufficiently mixed into the melt.

SUMMARY OF THE INVENTION

With the present invention, there is provided injection equipment or apparatus for adding particulate material to a liquid, for example a metal melt, which is considerably more efficient than known solutions and which has considerably wider application in that it can be used not only for adding powder such as aluminum fluoride or magnesium fluoride in connection with purifying aluminum melts, but also for adding larger particles such as granules, needles, crushed slag particles or chips in connection with alloying up or resmelting. Furthermore, the invention involves little agitation but nevertheless achieves rapid mixture and high utilization (low consumption) of the additives, for example in connection with melt purification or other liquid processing. Furthermore, the consumption of any gas can be controlled and utilized fully without loss to the environment.

An injection rotor in accordance with the present invention is characterised in that a rotation body has a cone-like or funnel-like shape and is generally completely open at the bottom. With such a design of the rotation body, the particles will be brought to the rotor together with the gas and any liquid which is in the cavity in the rotation body and, on account of centrifugal force, will be fed outwards and downwards, partly along the funnel-shaped wall of the body, and mixed with the liquid. This will produce a good mixture of the material without damaging agitation and the rotor will be "self-cleaning" as the stream of particles is directed outwards and downwards along the wall. In other words, there are no "pockets" where the material can become stuck.

By means of an advantageous design of the invention, the material is fed through a stationary tube or lance arranged coaxially in a bore in the rotor shaft. This allows any gas which is used to feed the material to be returned completely or in part via the space formed between the shaft and the supply tube, and such gas can be reused.

BRIEF DESCRIPTION OF THE DRAWINGS

The present invention will be described in the following in more detail by means of examples and with reference to the enclosed drawings where.

DETAILED DESCRIPTION OF THE INVENTION

Figure 1:
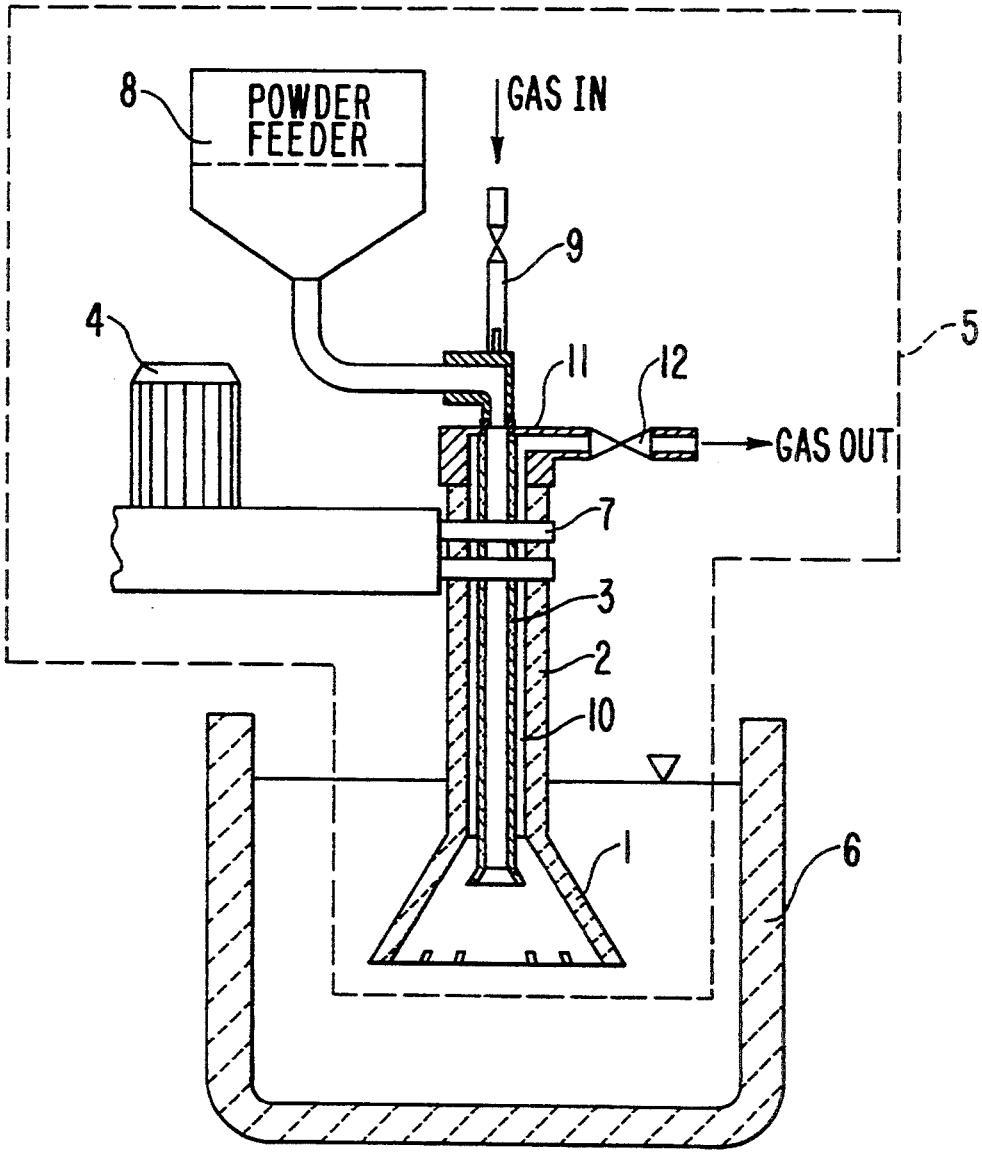
FIG. 1 is a schematic diagram of injection equipment in accordance with the present invention; and FIGS. *2a*, *2b*, *2c* and *2d* are schematic views showing alternative design forms of a rotation body shown in FIG. 1.
Figure 2A:
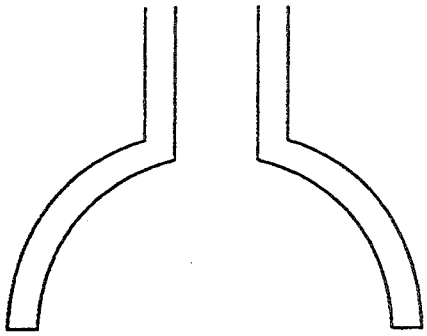
Figure 2B:
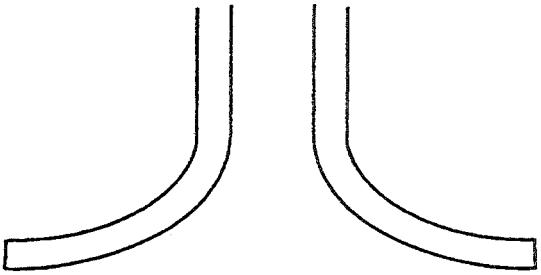
Figure 2C:
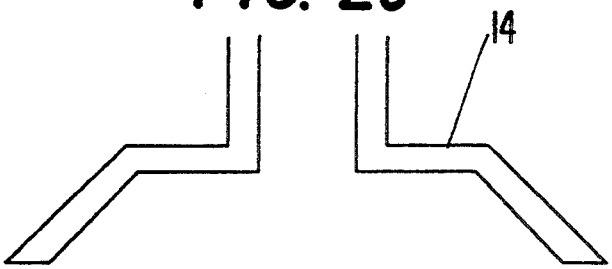
Figure 2D:
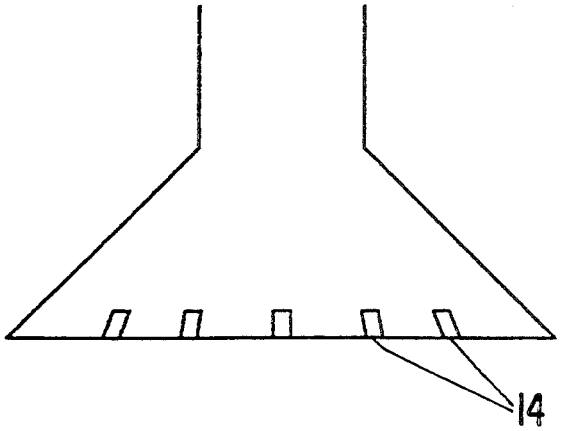

The injection equipment 5 in accordance with the present invention as shown in FIG. 1 comprises a cone-shaped or funnel-like rotation body 1 which is screwed in place or fastened in another way (not shown in detail) to a shaft 2. The shaft with the rotation body is rotated by means of a drive unit 4 via a belt transmission 7 or similar arrangement.

In the preferred example illustrated material is supplied by means of gas (pneumatically) from a container 8 or similar arrangement and via a stationary tube 3 which passes through a coaxial bore in shaft 2. The gas, which is supplied through a supply line 9 and takes the material with it through tube 3, can be returned completely or in part and be reused by passing it back via a space 10 between the tube 3 and the shaft 2 and out through a pipe connection 11. The quantity of gas which is returned can be adjusted by means of valve 12 on the pipe connection 11. Thus, the level of a liquid within the cone or body 1 can be adjusted from a level at which the liquid is at the lower end of the cone to a level at which it is immediately adjacent or by the outlet of the supply tube 3. A surplus of gas may be supplied so that the rotor can also be used for melt purification, for example. In such case the gas will flow out through the downward-facing opening in the cone and, because of the rotation thereof, the gas is finely distributed in the liquid. Preliminary tests have shown that, used for liquid purification, the arrangement of the invention is at least as efficient as existing rotor solutions.

Used for the purpose of adding material to a liquid, the present invention functions in the manner described above. The material is fed through a shaft via tube 3 to the internal cavity in the rotating cone 1 where it is mixed with the liquid. A cavity or gas pocket is formed as stated above on account of the gas supply, and under the cavity in the cone is created a uniform liquid surface which is continually renewed on account of the centrifugal forces which the rotating cone imparts to the liquid. Also, the gas which is located within the cavity in the cone will, as stated, be caused to rotate and when the material, in the form of particles, arrives in the cavity, the particles will partly fall down and be mixed with the liquid directly and partly, on account of the centrifugal force, be slung outwards and downwards and fed along the conical wall and then mixed with the liquid. In this connection, it should be noted that the angle formed by the wall of the cone with the vertical axis must be sufficiently large such that the particles do not stick to the wall, but "skid" along the wall outwards and downwards. If the level of liquid inside the cavity is above the lower edge, i.e. a little way up in the cone as shown on the drawing, the particles will, when they have come down into the liquid, be fed further outwards and downwards along the wall of the cone by means of the liquid. By raising the level of the liquid inside during operation, the liquid can be made to flow along the internal wall of the cone and thus ensure that any material which has stuck to the wall is removed. An increase in the level of the liquid inside the rotor will otherwise increase the agitation power of the rotor.

Even if, in the foregoing example, it was stated that it will be possible to feed the material which is added to the liquid pneumatically, it is also possible, within the scope of the invention, to feed and dose the material via tube 3 by means of a screw feeder. Here it is also possible to feed the material through the bore in the shaft without using an internal stationary tube 3. Using an internal stationary tube, however, avoids material being deposited inside the tube (no centrifugal forces which cause deposits when the pipe does not rotate).

Furthermore, regarding the design of the rotor, the expression "cone" is not restricted to the example shown in FIG. 1, but can cover solutions where the cone is partly spherical with a convex or concave wall surface FIGS. *2a* and *2b*, or has a larger diameter with an upper horizontal wall 14 as shown in FIG. *2a–2d*. Moreover, FIG. *2d* shows an example of a rotor which is provided with recesses or milled tracks 13 to increase agitation power and to improve the spread or distribution of the material in the liquid. Instead of recesses, "nipples" or blade-like elevations also can be used.

We claim:

1. An injection apparatus for supplying gaseous or particulate material to a liquid such as molten metal, said apparatus comprising:

a rotatable shaft;

a substantially downwardly open rotation body mounted on and rotatable with said shaft and lowerable into the liquid;

said shaft having therethrough a coaxial bore opening into said rotation body; and a stationary tube extending coaxially through said bore with an annular clearance between said tube and said shaft;

whereby material can be supplied through said tube to the liquid.

2. An apparatus as claimed in claim 1, further comprising a gas inlet connected to said tube, and a gas outlet leading from said annular clearance.

3. An apparatus as claimed in claim 2, wherein said gas inlet opens into said tube at a top thereof.

4. An apparatus as claimed in claim 3, wherein said gas outlet exits from a top of said annular clearance.

5. An apparatus as claimed in claim 2, wherein said gas outlet exits from a top of said annular clearance.

6. An apparatus as claimed in claim 1, further comprising a material supply leading to said tube.

7. An apparatus as claimed in claim 6, wherein said material supply opens into a top of said tube.

8. An apparatus as claimed in claim 6, wherein said material supply comprises a feed screw to dose the material.

9. An apparatus as claimed in claim 1, wherein said rotation body is cone-shaped.

10. An apparatus as claimed in claim 1, wherein said rotation body has a downwardly concave partly spherical wall surface.

11. An apparatus as claimed in claim 1, wherein said rotation body has a downwardly convex partly spherical wall surface.

12. An apparatus as claimed in claim 1, wherein said rotation body includes a horizontal upper wall with a conical wall tapering downwardly and outwardly therefrom.

13. An apparatus as claimed in claim 1, wherein said rotation body has recesses formed in a bottom thereof.

* * * * *